United States Patent [19]

Morrell et al.

[11] Patent Number: 4,501,448

[45] Date of Patent: Feb. 26, 1985

[54] UNIVERSAL RIPPER MINER

[75] Inventors: Roger J. Morrell, Bloomington; David A. Larson, Minneapolis, both of Minn.

[73] Assignee: The United States of America as represented by the Secretary of the Interior, Washington, D.C.

[21] Appl. No.: 455,187

[22] Filed: Jan. 3, 1983

[51] Int. Cl.[3] ..... E21C 29/30

[52] U.S. Cl. ..... 299/67; 299/91

[58] Field of Search ..... 299/91, 67, 79, 33

[56] References Cited

U.S. PATENT DOCUMENTS

| | | | |
|---|---|---|---|
| 1,572,009 | 2/1926 | Hansen | 299/67 |
| 2,606,013 | 8/1952 | Acker, Jr. | 299/67 |
| 3,032,325 | 5/1962 | Petersen | 299/67 |
| 3,404,920 | 10/1968 | Tabor | 299/67 |
| 3,731,977 | 5/1973 | Benedck et al. | 299/67 |
| 3,870,369 | 3/1975 | Löbbe | 299/67 |
| 4,190,294 | 2/1980 | Fikse | 299/67 |
| 4,203,626 | 5/1980 | Hamburger | 299/67 |
| 4,349,236 | 9/1982 | Hamburger et al. | 299/67 |
| 4,387,928 | 6/1983 | Stevens | 299/67 |

*Primary Examiner*—William F. Pate, III
*Attorney, Agent, or Firm*—Thomas Zack

[57] ABSTRACT

A universal ripper miner used to cut, collect, and transfer material from an underground mine working face. The cutter head has a single large cutting bit attached to its periphery and moves in an arcuate cutting motion in a cycle less than 270°. At each cutting cycle the bit's depth of material penetration is initially zero, increases to its maximum depth at about midway, and decreases to zero depth as it exits. Drive members, such as hydraulically actuated pistons, provide for this movement of the head/bit. Constructed as part of the cutting head adjacent to the bit, a hopper-type member with a partially opened upper section acts to continuously collect and transfer cut material from the mine face. A mechanically or gravity actuated door is at the end of this hopper member remote from the cutting head allows the cut material to be transferred to a lower conventional material handling system. The cutter head and its mounted frame can be moved in a direction perpendicular to the direction of the cutting head during its cutting cycle to allow a new adjacent cutting cycle to be performed. Also, after a desired number of cycles have taken place, the frame and cutting head can be advanced into the mine working face by a third power source.

9 Claims, 13 Drawing Figures

Fig 1.
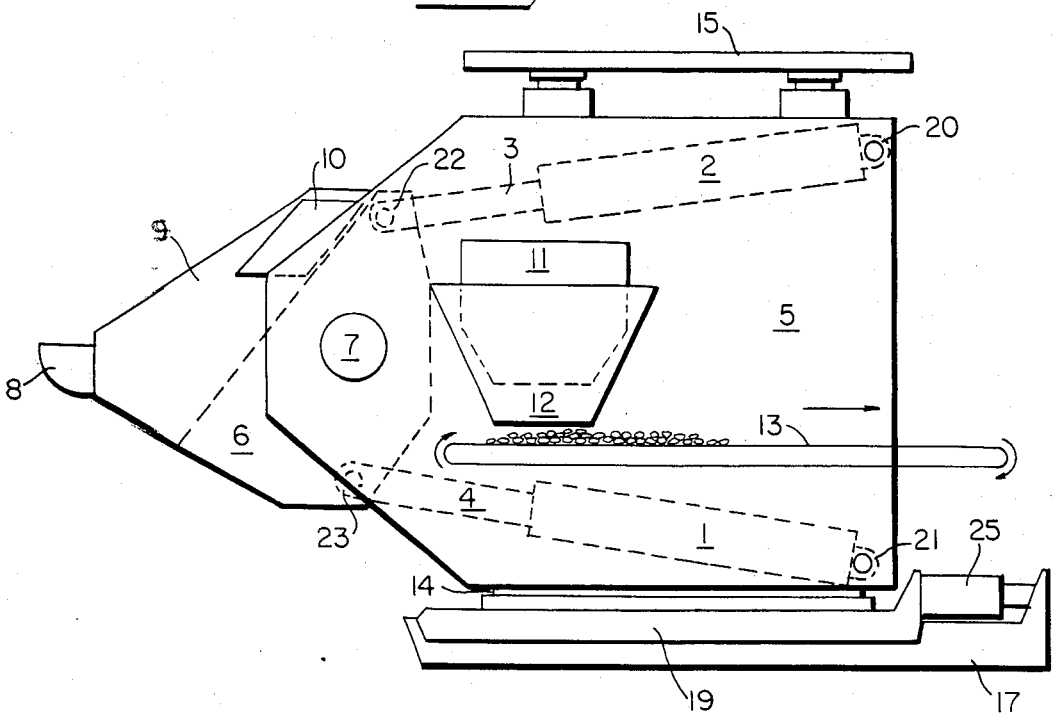
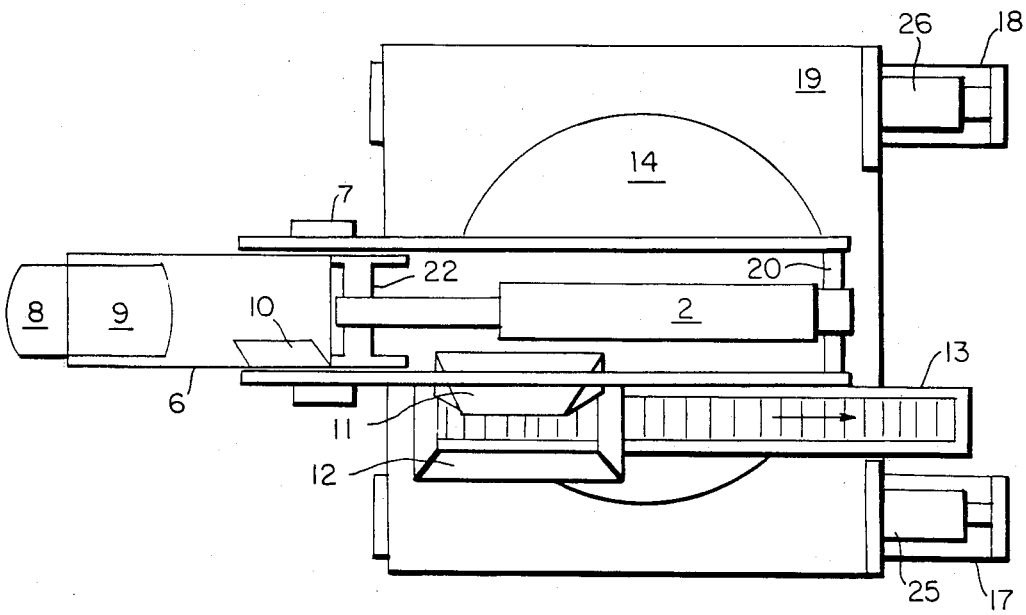
Fig 2.

UNIVERSAL RIPPER MINER

BACKGROUND OF THE INVENTION

Our invention is an excavation system which can cut, collect and transfer the cut material.

DESCRIPTION OF THE PRIOR ART

Excavation systems which mechanically extract materials in underground civil and mining operations can generally be divided into two major categories. These are boring machines and continuous miners. Boring machines include full-face tunnel borers and undercutting-type borers. Essentially they are large, self-advancing rotary drills capable of cutting a circular or rectangular face in a continuous manner directly—usually perpendicular—into the material to be excavated. Hard rock borers in this country use some type of roller cutter, either disk or carbide button.

Continuous miners use a drum-type head and cut the material with small drag bits mounted on the rotating drum or cutter head. In their cutting cycle, the mine face is transversed in a regular pattern with only a small portion of the mine face material being extracted at any given time. Usually these miners are crawler mounted and have a muck pickup built into the front of the machine.

Both the boring and continuous miners have certain drawbacks and limitations. The boring machines are unable to handle bad ground conditions such as mixed face, caving ground, blocky ground, high water inflows, etc. They experience high cutter and saddle wear in bad ground and it is difficult and time consuming to change the borer's cutters. Due to their large size, the borer requires a long time to set it up and is very difficult to maneuver within the size constraints of an underground mine (e.g., it usually requires a 300 to 400 foot turning radius). Further, they are complicated machines with high maintenance demands, low availability, and sophisticated logistics requirements.

Continuous miners also have their limitations. Since they are usually designed to cut coal and soft rock (i.e., an unconfined compressive strength of less than 10,000 psi), they are unable to cut harder rock at sustained rates and also have high maintenance requirements. If a large amount of hard rock is encountered by the continuous miner, it may have to be replaced by another method.

Our present ripper miner invention has some very distinct and meaningful advantages over both continuous miners and borers. It is more versatile in that it was designed to excavate any material commonly encountered during mining operations including soils, weak rock, coals, and very hard rocks such as granites and basalts. It is also capable of the high production rate, in the preferred embodiment about 700 tons per shift, which can be increased by increasing the size of the bit and power available. The simple compact design of our ripper also provides a highly maneuverable, low cost, and high reliability miner. Its maneuverability is illustrated by its ability to handle slopes up to 30 percent and to make almost right angle turns. There are no excavation machines currently available which can efficiently mine hard rock in a typical mining environment. The boring machines are not flexible or maneuverable enough, and the continuous miners can only cut very weak rock at acceptable rates.

SUMMARY OF INVENTION

A mine excavation and material pickup machine having a single wide bit cutter unit. In one cutting swing, the bit moves along an arcuate path, which is less than 270 degrees, with a depth of cut into the material which gets progressively deeper until about half of the arcuate swing is completed. At the end of each cutting cycle, the rock cuttings are transferred to a materials handling system. This collection and transfer occurs simultaneously with the cutting process by providing a material collecting container on the cutter's head next to and movable with the bit.

DESCRIPTION OF THE DRAWINGS

FIGS. 1 and 2 depict the preferred embodiment of the ripper miner in a side and top view, respectively.

DESCRIPTION OF THE PREFERRED EMBODIMENT

Figure 3A:
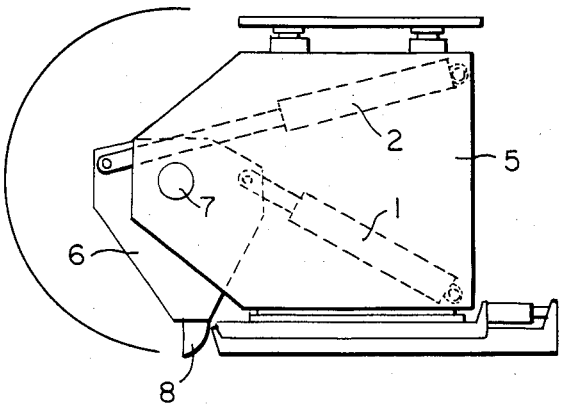
FIGS. 3(*a*)–(*c*) sequentially depicts how the preferred embodiment of the cutting element of our invention (FIG. 1) would engage the face through a complete cutting swing or cycle.

Basically our invention performs a cutting and mucking operation on material to be recovered. Thereafter, the material is conveyed from the underground mine to the surface by a materials handling system—like a conventional mine conveyor—which system in and by itself forms no part of this invention. The preferred embodiment of the machine to perform the cutting operation is illustrated by the equipment shown in FIGS. 1 and 2. The two hydraulically operated pistons 1 and 2 (see FIG. 1) with their movable and extendable piston rods 3 and 4, respectively, are attached to the cutter head 6. At one end, the pistons are pivotally attached by roller shafts 20 and 21 to the machine's main frame 5 and at the other end to the moveable cutter head by roller shafts 22 and 23. A center shaft 7 allows the cutter head 6 with its drag bit 8 to rotate in an arcuate path as the attached two piston rods are reciprocated by a power source (not shown) within their respective movable pistons. The cutter head rotates in an arcuate vertical path through approximately 185 degrees during its cutting swing or cycle. As the rock is cut loose from the face by drag bit 8, the cuttings are continuously collected in the hopper 9 section of the cutter head which moves in unison with the drag bit. At the end of the cutting swing, a door 10 to the hopper opens and dumps the cuttings through chute 11 into an external bin 12. From this bin, the cuttings are fed onto a conventional conveyor belt 13 and moved to the end of the machine and then into the mine haulage system. After each vertical cutting swing, the bit is returned to its initial starting position (FIG. 3(*a*)). The main frame 5 and cutter head are then rotated horizontally by the rotary table 14 into position for the next cutting swing. The roof jack assembly 15 pushes against the roof to lock the machine firmly in place during the cutting operation. After the bit has cut across the entire face of the heading, the main frame and cutting head are advanced forward (i.e., towards the mine working face) for the next cutting cycle by the two advance pistons 25 and 26. These pistons slide the entire machine, which is mounted to the base plate 19, along the walking beams 17 and 18. After three to four advance cycles, the machine is raised up off of the ground by jacks (not shown), the advance pistons retracted, and the machine is ready for another series of cutting advances at a new location to the right or left of its previous cutting cycle position. Thus, it is to be noted that the machine advances forward between a series of individual cutting cycles and the machine is rotated horizontally during each of its individual cutting cycles or swings.

Figure 3B:
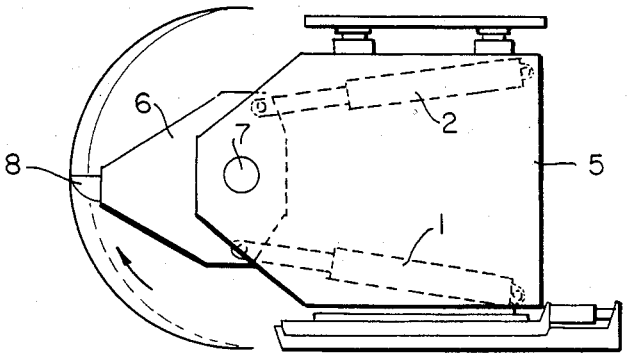
Figure 3C:
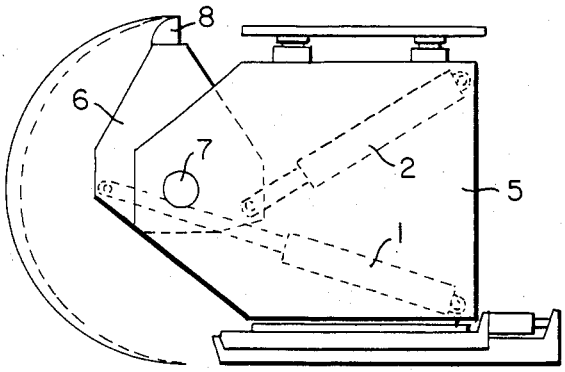
Figure 4:
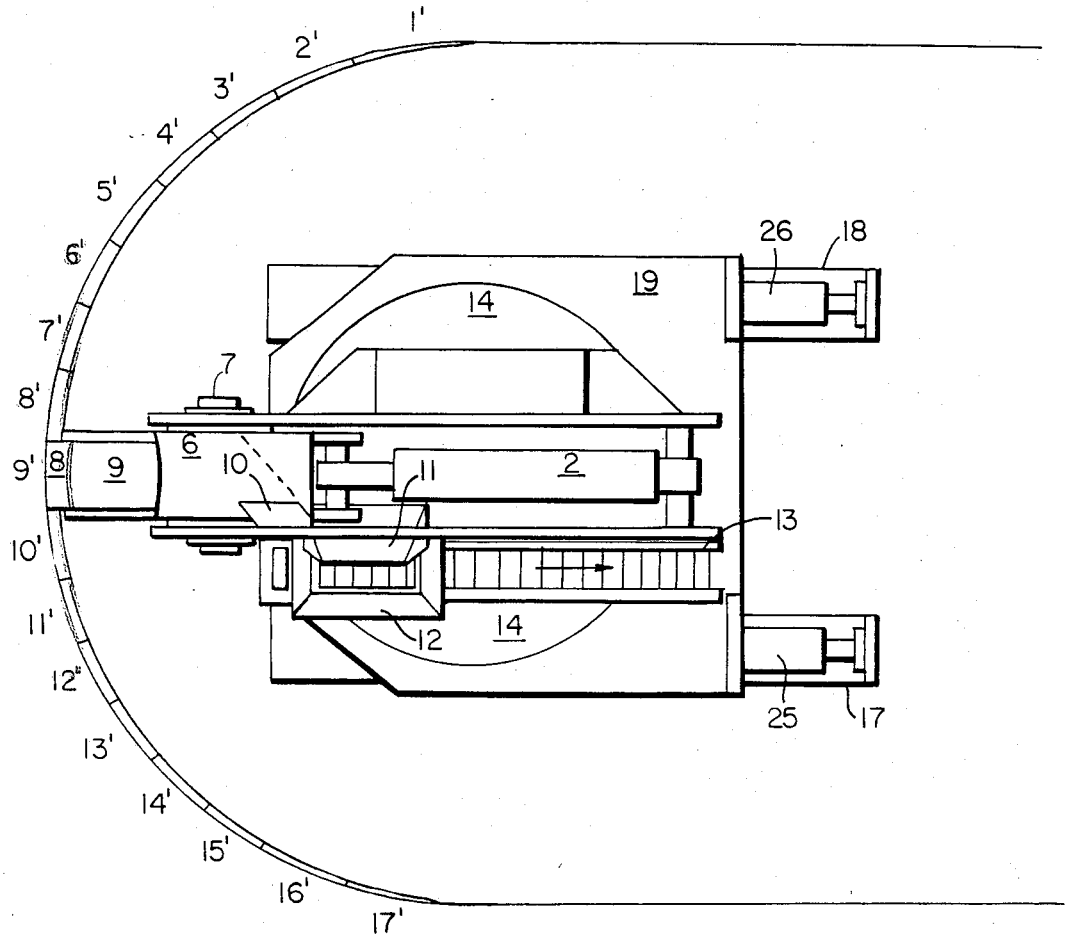
FIG. 4 illustrates a top view of the horizontal rotation of the ripper miner and the sequence of cutting swings across the mine face with each number constituting one cutting cycle.

The cutting swing or cycle is sequentially illustrated in FIGS. 3(*a*)–(*c*). FIG. 3(*a*) shows the cutter head at its initial position at the start of the cutting swing. FIG. 3(*b*) shows the cutter head after it has been rotated vertically about 90 degrees around its center shaft 7 from the initial position. In this mid-cut position, the drag bit 8 penetrates its deepest depth into the material being cut. Thereafter, FIG. 3(*c*), the bit is shown further rotated clockwise in a vertical plane to complete the cutting cycle. The total arcuate angle the bit passes through in its cutting cycle is about 185 degrees. After the swing is complete, the bit is rotated back in a non-cutting motion to its FIG. 3(*a*) initial position. The machine will then be rotated horizontally (via table 14) into position for its next cut and the cutting cycle repeated. This process is repeated by a series of cycles until the entire face of the heading has been cut. The horizontal rotation and the sequence of cuts is schematically illustrated in the FIG. 4 top view. The cuts begin at one side of the excavation at 1' and ends at cut 17', thus, each of these numbers represents one complete cycle as described with respect to FIGS. 3(*a*)–(*c*). After cut 17', the entire machine would advance forward (by pistons 25 and 26) one cut depth and the cutting cycle repeated with 17' being the first cut and 1' being the last. Note that each pass of the bit is adjacent to the last cut (except for the first) so that a free face exists for the bit at the top and side of the cutter. This step is very important to the success of the operation of our invention as it increases the efficiency of the cutting process. We have also found that the maximum depth of cut should be no more than one-third the width of the bit for efficient cutting. Thus, if the bit were 12 inches wide, it should be able to cut a maximum depth of 4 inches per pass. The deep cuts, possible with a wide bit cutter, are also very important because they allow the cutter to take advantage of the natural flaws and weaknesses in the rock to help form chips. Finally, the deeper the cuts per pass, the fewer the passes or cycles of the bit required to advance the excavation a given distance. This is important to bit wear since bit wear is directly related to the distance the bit travels through the material, i.e., the greater the travel the more wear, or conversely the less the travel, the less the cutter bit wear. For hard abrasive rocks the reduction of bit travel is of critical importance.

Figure 5A:
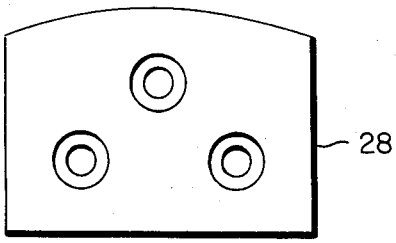
FIGS. 5(*a*)–(*b*) and 6(*a*)–(*b*) show the cutter bit (FIG. 5) by itself and the bit inserted in the bit holder (FIG. 6).
Figure 5B:
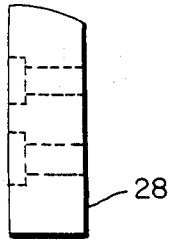
Figure 6A:
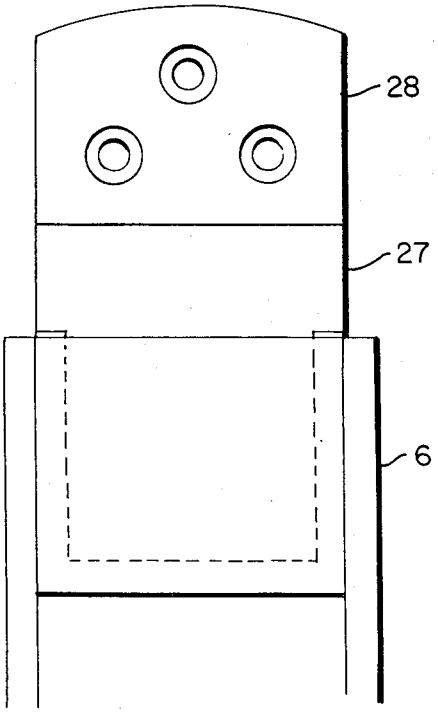
Figure 6B:
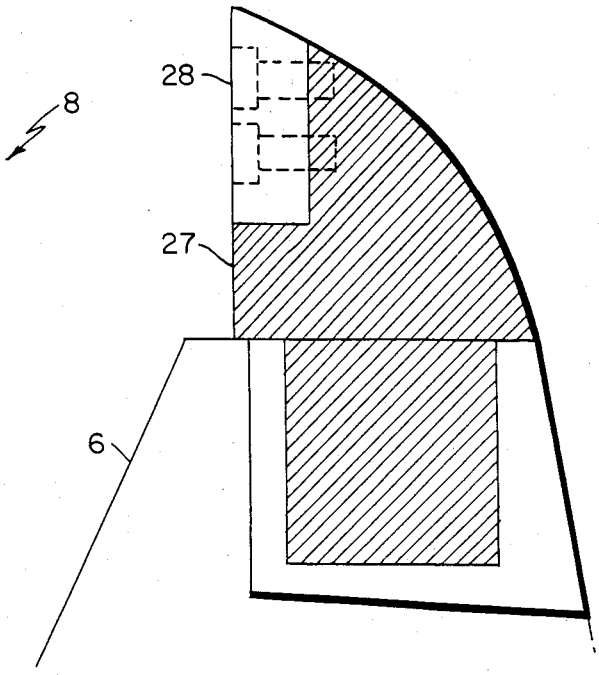

The drag cutter 8 is shown in FIGS. 5(*a*) and (*b*) and 6(*a*) and (*b*). It consists of the bit insert 28 and the bit holder 27. The bit holder resists the cutting forces and holds the bit insert in place. The bit insert does the actual rock cutting. It is held in place on the holder by bolting as shown, or it could be held by clamping, or brasing. The bit insert may have different shapes, sizes, and cutting geometries, and can be fabricated of hard metal or tungsten carbide. The choice of the bit insert geometry and composition depends on the rock and formation properties. Generally, the drag cutters will be about 6- to 24-inches wide. In operation, only the bit insert need be replaced when required by wear or by changing rock conditions. When a large change is required in the bit insert, the bit holder can also be changed to a different size. It is estimated that one man will be able to change bit inserts in a few minutes.

Figure 7C:
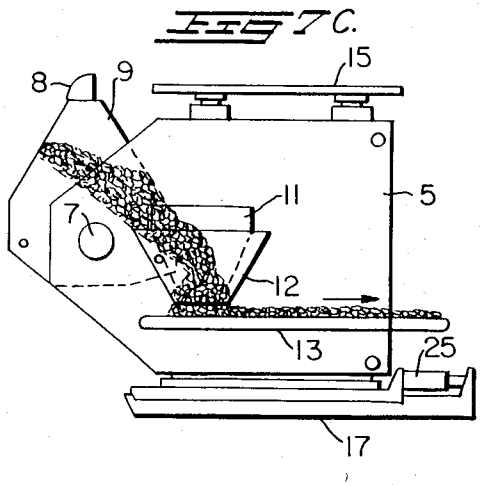
FIGS. 7(*a*)–(*c*), sequentially depicts how the material collection and transfer system operate in conjunction with the cutter head.
Figure 7B:
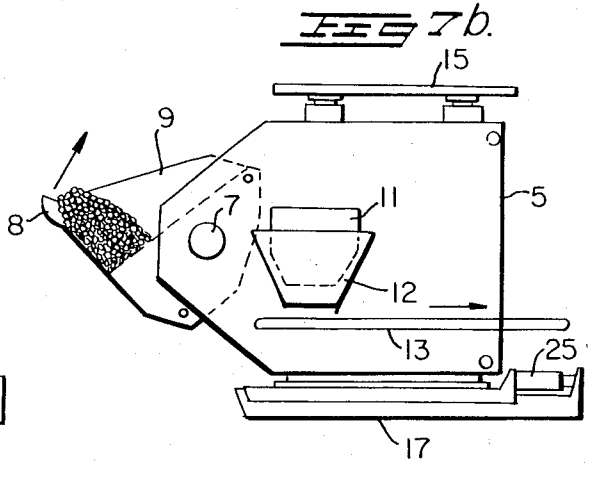
Figure 7A:
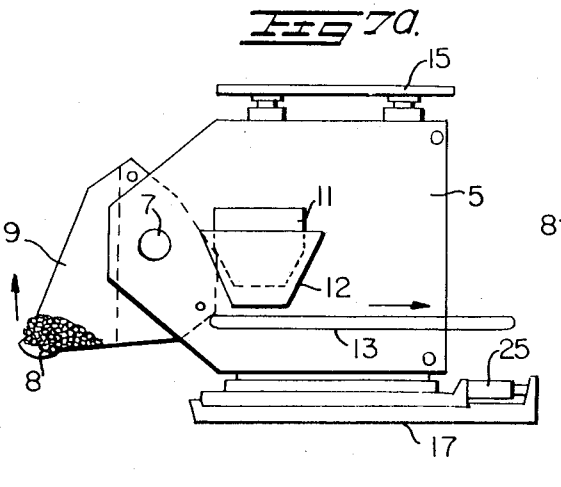

As the material is fragmented by the drag cutter, it is continuously collected. The process is illustrated in FIG. 7(*a*)–(*c*) which shows the cutter in the same position as FIGS. 3(*a*)–(*c*), respectively, but with cuttings. The purpose of the materials handling system is to continuously collect and transfer rock cuttings away from the mine working face without striking the floor and then deposit them in a materials handling system for transfer onto the main haulage system (not shown). Essentially as the material is cut, the cuttings are collected in a hopper 9 joined to the cutter head. Starting with FIG. 7(*a*), the cutting pass has begun and the hopper is beginning to fill. The process continues through FIG. 7(*b*) and is completed at FIG. 7(*c*). At the end of the cutting swing (FIG. 7(*c*)), the door 10 is opened and the cuttings are dumped by gravity through the chute 11 into the outside bin 12. From bin 12 they are fed onto the short power driven machine conveyor 13 from whence they will be transferred from the face to the main haulage system of the mine (not shown). By continuously collecting and transferring materials at the location where cut, the cuttings are not immediately dropped to the floor to create dust hazards and there is no need to pick the cuttings back up from the floor with some type of gathering arm loader or conveyor which equipment would be subject to high wear especially with abrasive materials.

As the ripper cutting machine attacks the mining face, a square to rectangular hole (front view) with a curved, concave face (top view) is formed. The width of this opening can be varied by adjusting the horizontal swing of the machine while the height of the opening can be varied by adjusting the length of the drag bit and by adjusting the extent of the vertical arc of the cutting swing or cycle.

From the foregoing description of the preferred embodiment of our universal ripper miner, it should be clear that its operation contemplates several types of motions in different directions. The movement of the single cutting head follows an arcuate trajectory during its cutting cycle in a generally vertical plane around the center shaft 7. Perpendicular thereto, the main frame 5 and its mounted cutter head 6, drive pistons 1 and 2, bit 8, etc., are rotated in a horizontal plane on rotary table 14 to position the cutting head for the next adjacent or sequential cutting cycle. In addition to these two rotary movements, the advance pistons 25 and 26, move or advance all of the mounted equipment on base plate 19 forward towards the mine working face after the desired number of cutting cycles in a series have been accomplished, e.g., the 17 cycles disclosed and illustrated with respect to FIG. 4. There is also a fourth movement of all of the equipment by a ground jack after all of the cycles advances by pistons 25 and 26 have taken place at a given location of the mine working face. This last movement raises the ripper miner completely off of the ground and is accomplished by one, centrally located ground jack which is not shown. Raising the miner off of the ground serves two purposes: First, it allows the advance pistons 25 and 26 to retract and reset for another series of advance cycles, and second, it allows the miner to be rotated clockwise or counterclockwise to change the direction of the machine.

Variations to the disclosed preferred embodiment should be clear to persons skilled in the art. The pistons 1 and 2 could be replaced by other types of drive mechanisms to cycle the cutter head or advance the base plate 19. The cuttings handling system could be designed to collect cuttings on the downstroke if the cutting swing were reversed from that described. The cutting arrangement shown in FIG. 3 could be reversed to cut on the downstroke when advantageous. Furthermore, the machine could be rearranged to yield a horizontal or inclined cutting stroke when formation properties would make this advantageous. None of these possible variations or changes should be used to limit the scope and spirit of our invention which is to be defined only by the claims that follow.

We claim:

1. A ripper miner comprising:

a movable cutter head having a cyclical cutting cycle transversing an arcuate angle of about 185° to less than 270° in a generally vertical plane;

a single material drag cutter having a bit holder and a single removable material engaging bit insert therein, said drag cutter being mounted on said cutter head and extending therefrom; said drag cutter being movable with the head to engage the material to be cut with its removable bit during the cutting cycle;

frame means to mount the cutter head;

first means for moving the cutter head and drag cutter with respect to said frame means from its initial position in the aforesaid cyclical arcuate motion and then returning the bit to its original position to provide for the removable bit entrance and exit into the material to be cut at minimum depth of cut with the greatest depth of penetration being approximately at the midway portion of the cutting cycle; and material collection and transfer means mounted on the cutter head and frame means for temporarily collecting and storing collected cuttings before they reach the mine floor.

2. The ripper of claim 1 wherein the removable bit engages the material to be at its greatest depth at an angle of approximately 90° through its cyclical cutting cycle; and the material collection and transfer mean moves in unison with the drag cutter in the direction of bit travel on its cutting cycle.

3. The ripper of claim 1 wherein the cutter head is rotatable with respect to the frame means and the insert bit is a solid metallic member with one side complementarily shaped to said bit holder where mounted.

4. The ripper of claim 1 wherein the material collection and transfer means is a hopper which is mounted on the cutter head, said hopper having an opened upper section adjacent to the cutter bit.

5. The ripper of claim 1 wherein the means for moving the cutter head comprises a pair of hydraulically actuated pistons each with extending piston rods attached to the head.

6. The ripper of claim 4 wherein said hopper has a mechanically or gravity actuated door located on the side opposite to the cutter bit.

7. The ripper of claim 1 also including second means for moving the cutting head in a direction generally perpendicular to said first means after the first cutting cycle has taken place to provide for a new cutting cycle to the mine working face thereat adjacent to the first cycle.

8. The ripper of claim 7 wherein the first means moves the cutting head in a generally vertical plane and said second means moves the cutting head in a generally horizontal plane.

9. The ripper of claim 8 also including a third means for advancing the frame and cutting head into the mine working face after the desired number of cutting cycles have been completed by said first and second means at a given mine face location.

* * * * *